US009418811B2

(12) United States Patent
Sasaki et al.

(10) Patent No.: US 9,418,811 B2
(45) Date of Patent: Aug. 16, 2016

(54) RELAY

(71) Applicant: Panasonic Intellectual Property Management Co., Ltd., Osaka (JP)

(72) Inventors: Tomoaki Sasaki, Mie (JP); Takafumi Imai, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/796,903

(22) Filed: Jul. 10, 2015

(65) Prior Publication Data

US 2016/0012993 A1 Jan. 14, 2016

(30) Foreign Application Priority Data

Jul. 11, 2014 (JP) ..... 2014-142915

(51) Int. Cl.

| | |
|---|---|
| ***H01H 51/01*** | (2006.01) |
| ***H01H 50/20*** | (2006.01) |
| ***H01H 50/44*** | (2006.01) |
| ***H01H 50/54*** | (2006.01) |
| ***H01H 50/64*** | (2006.01) |
| *H01F 7/16* | (2006.01) |
| *H01F 7/122* | (2006.01) |

(52) U.S. Cl.

CPC ..... *H01H 50/20* (2013.01); *H01H 50/443* (2013.01); *H01H 50/54* (2013.01); *H01H 50/64* (2013.01); *H01H 51/01* (2013.01); *H01F 7/122* (2013.01); *H01F 7/1615* (2013.01); *H01F 7/1623* (2013.01); *H01H 2050/446* (2013.01); *H01H 2201/00* (2013.01)

(58) Field of Classification Search

CPC .. H01H 2050/446; H01H 51/01; H01F 7/122; H01F 7/1615; H01F 7/1623; H01F 7/1646

USPC ..... 335/179, 229–234

See application file for complete search history.

(56) References Cited

U.S. PATENT DOCUMENTS 4,855,701 A * 8/1989 Yokoyama ..... H01H 89/10 335/230

FOREIGN PATENT DOCUMENTS

| | | | |
|---|---|---|---|
| JP | 61-114641 | U | 7/1986 |
| JP | 62-165826 | A | 7/1987 |
| JP | 2002-110013 | A | 4/2002 |
| JP | 2011-249137 | A | 12/2011 |

* cited by examiner

*Primary Examiner* — Ramon M Barrera

(74) *Attorney, Agent, or Firm* — McDermott Will & Emery LLP

(57) ABSTRACT

A relay includes a fixed contact point, a movable contact member and an electromagnetic device. The electromagnetic device includes a bobbin, a coil, a movable iron core, a first armature, a second armature, and a ferromagnetic member. The first armature has a first hole to which a first end portion of the movable iron core is insertion-fitted. The second armature has a second hole to which a second end portion of the movable iron core is insertion-fitted. The bobbin has a first rib formed on each of facing surfaces of a pair of first side pieces and a second rib formed on each of facing surfaces of a pair of second side pieces. The first armature is interposed between the first ribs of the pair of first side pieces and the second armature is interposed between the second ribs of the pair of second side pieces.

6 Claims, 13 Drawing Sheets

RELAY

CROSS-REFERENCE TO RELATED APPLICATION

This application claims priority to Japanese Patent Application No. 2014-142915 filed on Jul. 11, 2014, the entire contents of which are incorporated herein by reference.

TECHNICAL FIELD

The disclosure relates to a relay; and more particularly, to a relay including an electromagnetic device.

BACKGROUND ART

As for such a relay, there is known, e.g., a remote control relay (see, e.g., Japanese Unexamined Patent Application Publication No. 2011-249137).

In the remote control relay disclosed in Japanese Unexamined Patent Application Publication No. 2011-249137, there is accommodated in a case an electromagnetic device having a plunger moving reciprocally by power supply to a coil and an opening/closing mechanism for switching on/off of a contact part in response to the reciprocating movement of the plunger.

The electromagnetic device includes a coil, a coil bobbin, a plunger, two armatures, a yoke, a residual plate, two permanent magnets, and two auxiliary yokes.

The coil bobbin has a cylindrical tubular body around which a coil is wound, plate-shaped flanges provided at both end portions in an axial direction of the tubular body, and side pieces protruding from both edges of each of the flanges in a direction opposite to the tubular body.

The remote control relay disclosed in Japanese unexamined Patent Application Publication No. 2011-249137 is disadvantageous in that it is difficult for the armature provided between the two side pieces protruding in the same direction from the flange of the coil bobbin to move smoothly due to large friction between the two side pieces and the armature moving along the axial direction of the coil bobbin.

SUMMARY OF THE INVENTION

In view of the above, the disclosure provides a relay capable of improving an operation stability of an electromagnetic device.

In accordance with an aspect of the present invention, there is provided a relay including a fixed contact point; a movable contact member; and an electromagnetic device. The movable contact member is moved between a first position in contact with the fixed contact point and a second position separated from the fixed contact point in response to an operation of the electromagnetic device. The electromagnetic device includes a bobbin, a coil, a movable iron core, a first armature, a second armature, and a ferromagnetic member. The bobbin includes: a tubular body around which the coil is wound, the movable iron core penetrating through the tubular body; a first flange protruding outward from a first end portion in an axial direction of the tubular body; a second flange protruding outward from a second end portion in the axial direction of the tubular body; a pair of first side pieces protruding in a direction opposite to the tubular body from both edges in a width direction of the first flange which is perpendicular to the axial direction of the tubular body; and a pair of second side pieces protruding in a direction opposite to the tubular body from both edges in a width direction of the second flange which is perpendicular to the axial direction of the tubular body. The movable iron core has a first end portion, a second end portion and an intermediate portion therebetween, and cross sectional areas of the first end portion and the second end portion perpendicular to the axial direction of the tubular body are smaller than a cross sectional area of the intermediate portion perpendicular to the axial direction of the tubular body. The first armature has a first hole to which the first end portion of the movable iron core is insertion-fitted. The second armature has a second hole to which the second end portion of the movable iron core is insertion-fitted. The ferromagnetic member has a rectangular frame shape surrounding the bobbin, the coil, the first armature and the second armature, a first insertion hole through which a part of the first end portion of the movable iron core that protrudes beyond the first armature penetrates, and a second insertion hole through which a part of the second end portion of the movable iron core that protrudes beyond the second armature penetrates. The bobbin has at least one first rib formed along the axial direction of the tubular body on each of facing surfaces of the pair of first side pieces and at least one second rib along the axial direction of the tubular body on each of facing surfaces of the pair of second side pieces. The first armature is interposed between the first ribs of the pair of first side pieces and the second armature is interposed between the second ribs of the pair of second side pieces.

With such configurations, it is possible to improve the operation stability of the electromagnetic device.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Hereinafter, a relay 1 according to an embodiment will be described with reference to FIGS. 1 to 8, 9A, 9B and 10.

Figure 4:
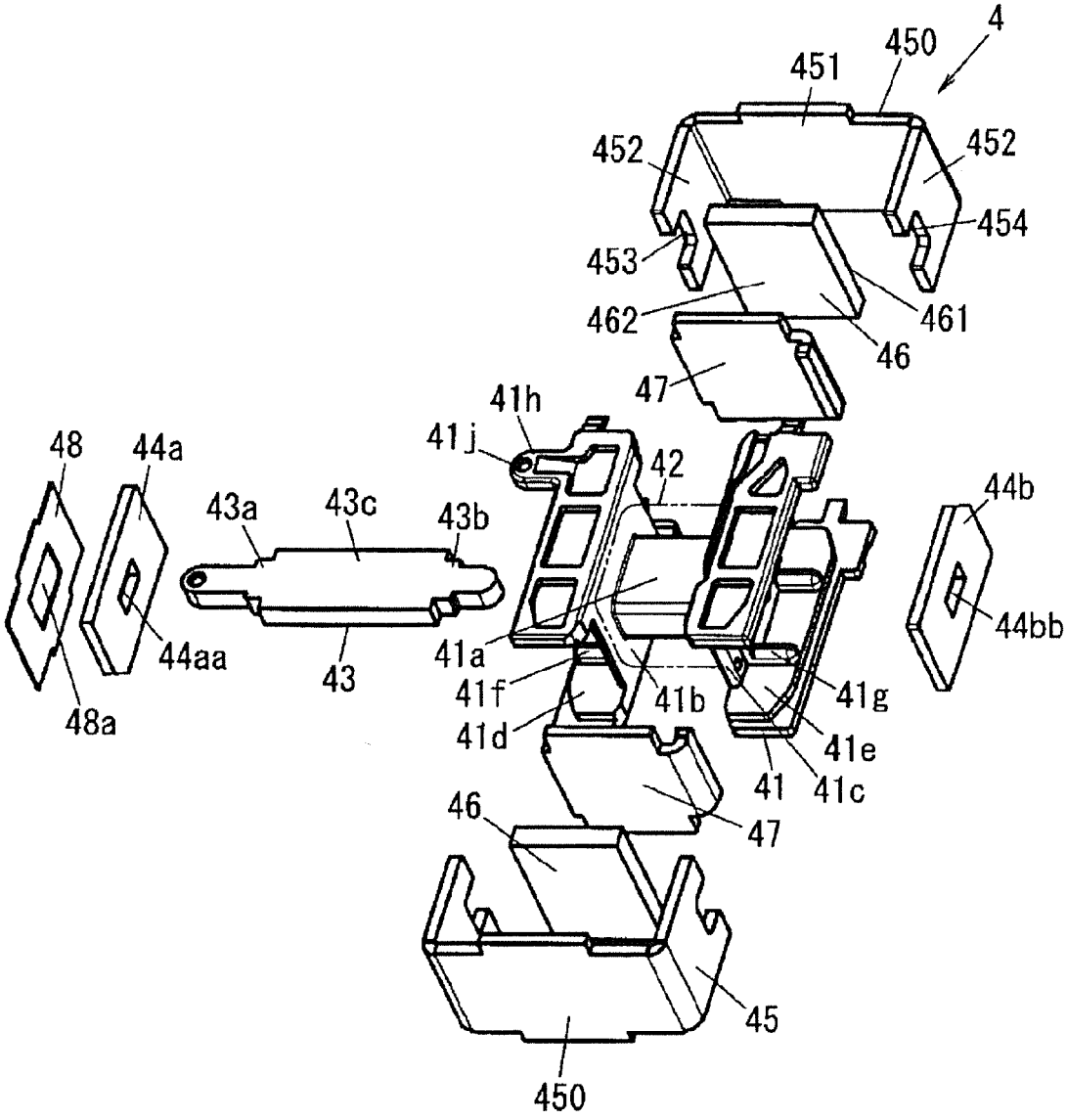
FIG. 4 is a schematic exploded perspective view of an electromagnetic device in the relay according to the embodiment.
Figure 5:
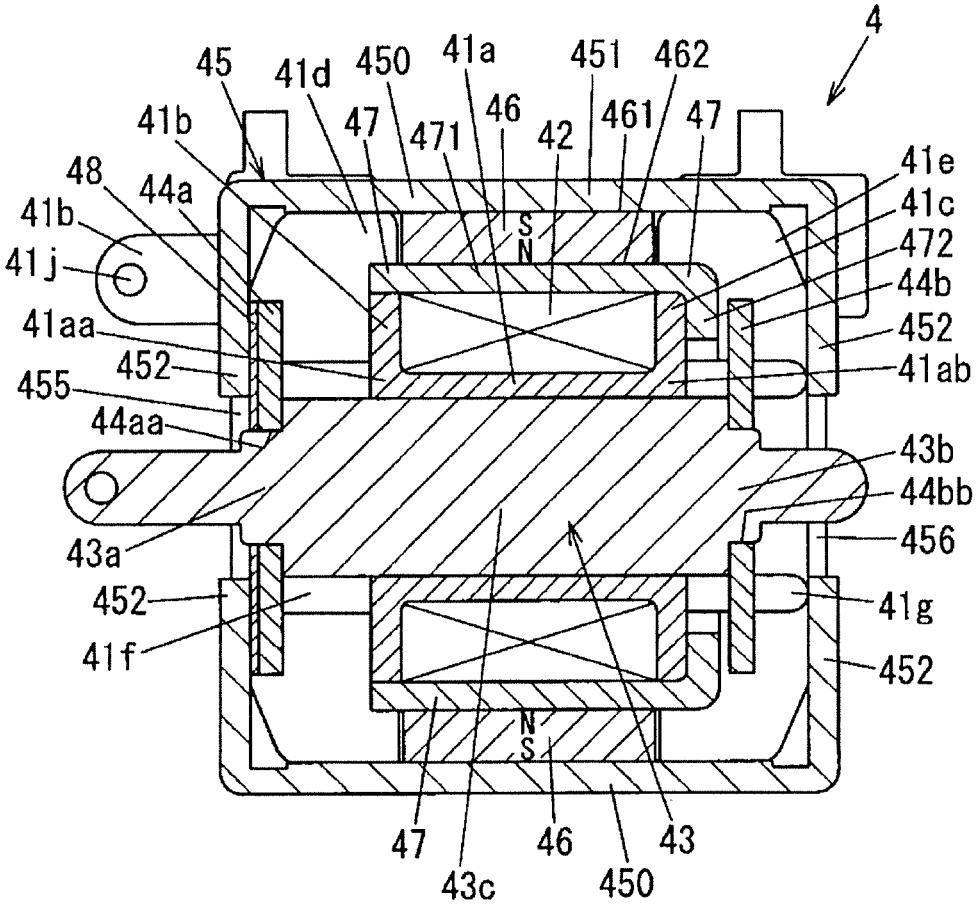
FIGS. 5 and 6 are schematic cross sectional views of the electromagnetic device in the relay according to the embodiment.
Figure 6:
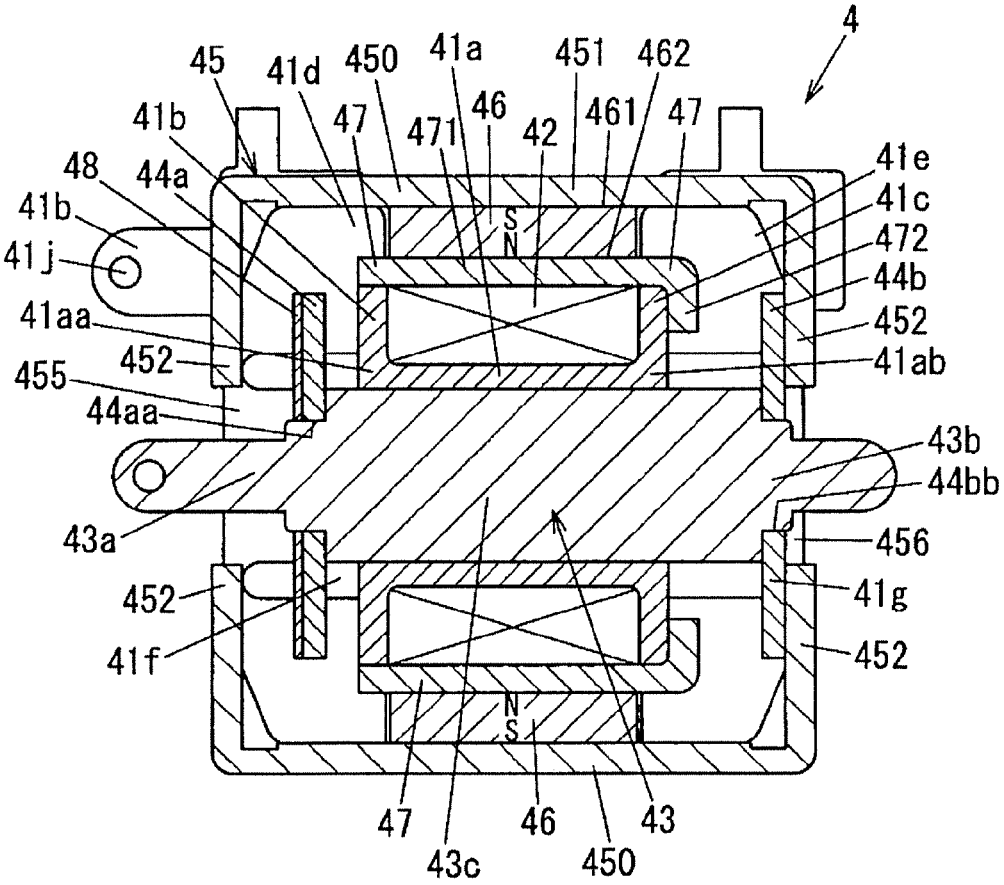
Figure 7:
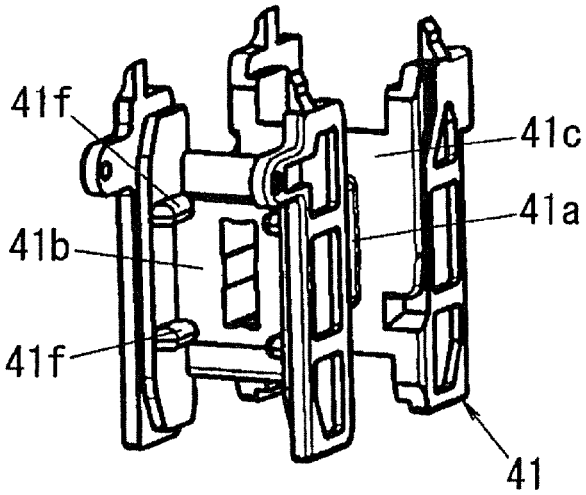
FIG. 7 is a schematic perspective view of a bobbin in the relay according to the embodiment.
Figure 8:
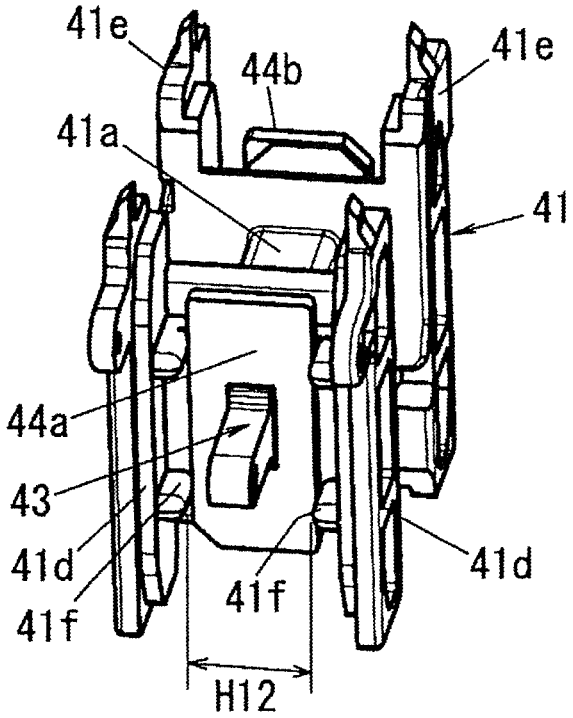
FIG. 8 is a schematic perspective view of principal parts of the electromagnetic device in the relay according to the embodiment.

The relay 1 includes a fixed contact point 2, a movable contact member 3, and an electromagnetic device 4. In response to an operation of the electromagnetic device 4, the movable contact member 3 is moved between a first position in contact with the fixed contact point 2 (see FIG. 2) and a second position separated from the fixed contact point 2 (see FIG. 3). As shown in FIGS. 4 to 6, the electromagnetic device 4 has a bobbin 41, a coil 42, a movable iron core 43, a first armature 44*a*, a second armature 44*b*, and a ferromagnetic member 45. The bobbin 41 has a tubular body 41*a* around which the coil 42 is wound and through which the movable iron core 43 penetrates. Further, the bobbin 41 has a first flange 41*b* protruding outward from a first end portion 41*aa* in an axial direction of the tubular body 41*a*, and a second flange 41*c* protruding outward from a second end portion 41*ab* in the axial direction of the tubular body 41*a*.

The bobbin 41 has a pair of first side pieces 41*d* protruding in the opposite direction to the tubular body 41*a* from both edges of the first flange 41*b* in a width direction (right-left direction in FIG. 9A) perpendicular to the axial direction of the tubular body 41*a*. Moreover, the bobbin 41 has a pair of second side pieces 41*e* protruding in the opposite direction to the tubular body 41*a* from both edges of the second flange 41*c* in the width direction (right-left direction in FIG. 9B) perpendicular to the axial direction of the tubular body 41*a*.

In the movable iron core 43, cross sectional areas of a first end portion 43*a* and a second end portion 43*b* in a direction perpendicular to the axial direction of the tubular body 41*a* are smaller than a cross sectional area of an intermediate portion 43*c* in a direction perpendicular to the axial direction of the tubular body 41*a*.

The first armature 44*a* has a first hole 44*aa* to which the first end portion 43*a* of the movable iron core 43 is press-fitted. The second armature 44*b* has a second hole 44*bb* to which the second end portion 43*b* of the movable iron core 43 is press-fitted.

The ferromagnetic member 45 has a rectangular frame shape surrounding the bobbin 41, the coil 42, the first armature 44*a* and the second armature 44*b*. The ferromagnetic member 45 has a first insertion hole 455 (see FIG. 5) through which a part of the first end portion 43*a* of the movable iron core 43 that protrudes beyond the first armature 44*a* penetrates. Further, the ferromagnetic member 45 has a second insertion hole 456 (see FIG. 5) through which a part of the second end portion 43*b* of the movable iron core 43 that protrudes beyond the second armature 44*b* penetrates. The bobbin 41 has first ribs 41*f* formed on facing surfaces of the pair of the first side pieces 41*d* to extend along the axial direction of the tubular body 41*a*, and second ribs 41*g* formed on facing surfaces of the pair of the second side pieces 41*e* to extend along the axial direction of the tubular body 41*a*. The first armature 44*a* is interposed between the first ribs 41*f* of the pair of the first side pieces 41*d*. The second armature 44*b* is interposed between the second ribs 41*g* of the pair of the second side pieces 41*e*. Therefore, the relay 1 can improve the operation stability of the electromagnetic device 4.

The relay 1 preferably includes a case 10 for accommodating the fixed contact point 2, the movable contact member 3, the electromagnetic device 4 and the like. The relay 1 preferably further includes a first terminal 5, a second terminal 6, and a pair of third terminals 7. The fixed contact point 2 is electrically connected to the first terminal 5. The movable contact member 3 is electrically connected to the second terminal 6. In the relay 1, a series circuit of a load 305 (see FIG. 10) and a commercial power supply 306 (see FIG. 10) can be connected between the first terminal 5 and the second terminal 6, for example. In the relay 1, the coil 42 is electrically connected between the pair of third terminals 7. Therefore, the relay 1 can control on/off of the load 305.

Each of the components of the relay 1 will now be described in detail.

The relay 1 is a single winding type bistable relay (latching relay). The bistable relay is an electromagnetic relay that is operated forward or backward when an excitation input is applied to the coil 42 and maintains its state even after the excitation input is removed. Further, the relay 1 is a polar relay having a polarity by the excitation input of the coil 42. Therefore, the relay 1 needs to reverse a direction of power supply to the coil 42 in order to move the movable iron core 43 reciprocally. The relay 1 is a remote control relay. The relay 1 preferably satisfies standards of a remote control relay standardized as JIS C 8360.

The case 10 is preferably set to have a size of an agreement type circuit breaker for use in distribution panel specified in Annex XC of JIS C 8201-2-1, for example.

The case 10 is formed by combining a body 11 made of a synthetic resin material and a cover 12 made of a synthetic resin material. As for the resin material of the body 11 and the cover 12, PBT (polybutylene terephthalate) or the like may be used, for example. In the case 10, the body 11 and the cover 12 are preferably made of the same material. The body 11 is formed in a box shape having an opening 11*a* at one side thereof. The cover 12 has a flat plate shape that covers the opening 11*a* of the body 11. The case 10 is formed by combining the body 11 and the cover 12 by using four headed pins 15. The body 11 has four first through holes 11*b* through which the headed pins 15 penetrate. The cover 12 has four second through holes 12*b* through which the headed pins 15 penetrate. The case 10 is assembled by insertion-fitting the body 11 and the cover 12, allowing the headed pins 15 to penetrate through the second through holes 12 of the cover 12 and the first through holes 11*b* of the body 11, and coupling the body 11 and the cover 12 by performing plastic deformation on leading end portions of the headed pins 15.

The body 11 has two parallel partition walls 11*c* and 11*d* formed as one unit. The two partition walls 11*c* and 11*d* protrude toward the cover 12 from the surface of the body 11 which faces the cover 12. The two partition walls 11*c* and 11*d* are separated from each other in a lengthwise direction of the case 10. The electromagnetic device 4 accommodated in the case 10 is disposed such that the axial direction of the tubular body 41*a* becomes parallel to the lengthwise direction of the case 10. In the relay 1, a plate spring 16 is preferably disposed between the electromagnetic device 4 and the partition wall 11*d*. The plate spring 16 has a substantially U shape so that it does not interfere with the movable iron core 43. For example, the plate spring 16 has a substantially U shape so that it is not brought into contact with the movable iron core 43 moving along the lengthwise direction of the case 10. In the relay 1, it is possible to reduce impact generated by the movement of the movable iron core 43 due to the presence of the plate spring 16.

In the relay 1, the first terminal 5 and the second terminal 6 are arranged in the width direction of the case 10 at a first end portion in the lengthwise direction of the case 10. Further, in the relay 1, a pair of third terminals 7 is arranged in the width direction of the case 10 at a second end portion in the lengthwise direction of the case 10.

The first terminal 5 includes a first terminal plate 51, a first washer 52, and a conductive first terminal screw 53. A first shaft portion 53*b* of the first terminal screw 53 is inserted through the first washer 52 and fitted to a first screw hole 51*b* of the first terminal plate 51. The first terminal plate 51 is partially exposed to the outside of the case 10 and partially accommodated in the case 10. The first terminal plate 51 is a conductive plate such as a metal plate or the like. The first terminal plate 51 of the first terminal 5 is attached to the body 11 by the first terminal screw 53.

The second terminal 6 has a second terminal plate 61, a second washer 62, and a conductive second terminal screw 63. A second shaft portion 63*b* of the second terminal screw 63 is inserted through the second washer 62 and fitted to a second screw hole 61*b* of the second terminal plate 61. The second terminal plate 61 is partially exposed to the outside of the case 10 and partially accommodated in the case 10. The second terminal plate 61 is a conductive plate such as a metal plate or the like. The second terminal plate 61 of the second terminal 6 is attached to the body 11 by the second terminal screw 63.

The third terminal 7 has a third terminal plate 71, a third washer 72, and a conductive third terminal screw 73. A third shaft portion 73*b* of the third terminal screw 73 is inserted through the third washer 72 and fitted to a third screw hole 71*b* of the third terminal plate 71. The third terminal plate 71 is partially exposed to the outside of the case 10 and partially accommodated in the case 10. The third terminal plate 71 is a conductive plate such as a metal plate or the like.

In the relay 1, the fixed contact point 2 is electrically connected to the first terminal 5 and the movable contact member 3 is electrically connected to the second terminal 6. Therefore, in the relay 1, when the movable contact member 3 is in contact with the fixed contact point 2, the first terminal 5 and the second terminal 6 are electrically connected to each other via the fixed contact point 2 and the movable contact member 3. When the movable contact member 3 is separated from the fixed contact point 2, the first terminal 5 and the second terminal 6 are electrically insulated from each other.

The fixed contact point 2 is fixed to an extended piece 51 extending from the first terminal plate 51. The extended piece 51*c* has a substantially J shape. The fixed contact point 2 is fixed to a leading end portion of the extended piece 51*c*. The relay 1 includes a partition wall disposed between the first terminal 5 and the second terminal 6. The partition wall 18 has an electrical insulation property. The partition wall 18 is made of a synthetic resin.

The movable contact member 3 includes a plate spring 31 that is a long conductive plate, and a movable contact point 32 that is fixed to the plate spring 31 and can be brought into contact with the fixed contact point 2. The conductive plate is made of a metal material. In the movable contact member 3, the plate spring 31 and the movable contact point 32 may be formed as one unit. In the relay 1, the movable contact member 3 and the fixed contact point 2 form a contact part 100.

The movable contact member 3 has the movable contact point 32 at a first end portion 3*a* in a lengthwise direction thereof. A second end portion 3*b* in the lengthwise direction of the movable contact member 3 is electrically connected to the second terminal 6 through a flexible wire 65. The wire 65 is a braided conductor formed by braiding several copper wires.

In the relay 1, the bobbin 41 has a pair of supporting pieces 41*h* protruding from the pair of first side pieces 41*d* in the opposite direction to the first flange 41*b*. The pair of supporting pieces 41*h* has bearing holes 41*j* through which a cylindrical rod-shaped first shaft pin 101 penetrates. The first shaft pin 101 is accommodated in the case 10 along the width direction of the case 10 and supported by the case 10.

The relay 1 includes a long lever 8 that is rotatable about the first shaft pin 101. The lever 8 is made of a synthetic resin having an electrical insulation property. The lever 8 has a first bearing hole 81 at a central portion in a lengthwise direction thereof. The first bearing hole 81 allows the first shaft pin 101 to be rotatably supported. Therefore, the lever 8 is rotatably supported by the bobbin 41.

The lever 8 has a second bearing hole 82 at a first end portion 8*a* in a lengthwise direction thereof. In the lever 8, a cylindrical rod-shaped second shaft pin 102 attached to the first end portion 43*a* of the movable iron core 43 penetrates through the second bearing hole 82. The second shaft pin 102 is arranged in parallel to the first shaft pin 101. Accordingly, the lever 8 can rotate about the first shaft pin 101 by the movement of the movable iron core 43.

The lever 8 has a spring receiving portion 83 for holding a coil spring 9 between itself and the movable contact member 3, the spring receiving portion 83 being formed as one unit with the lever 8. The coil spring 9 applies a force to the movable contact member 3 so that a desired contact pressure can be obtained when the movable contact member 3 is in contact with the fixed contact point 2.

The spring receiving part 83 has a substantially U shape opened toward the movable contact member 3 side. More specifically, the spring receiving unit 83 has a substantially U shape formed by a central piece 83*a* and a pair of side pieces 83*b* protruding from both ends of the central piece 83*a* along the thickness direction of the central piece 83*a*. Formed at the central piece 83*a* of the spring receiving unit 83 is a first protrusion 83*d* to which one end portion of the coil spring 9 is fitted. Formed at an intermediate portion 3*c* in a lengthwise direction of the movable contact member 3 is a second protrusion (not shown) to which the other end portion of the coil spring 9 is fitted.

In the movable contact member 3, a hole 34 is formed between the second protrusion and the first end portion 3*a* while being separated from the second protrusion and the first end portion 3*a*. The lever 8 has a third protrusion (not shown) to be inserted into the hole 34 of the movable contact member 3, the third protrusion being formed as one unit with the lever 8. Further, the lever 8 has at the first end portion 8*a* a pivot protrusion 85 that can be brought into contact with the movable contact member 3.

A display piece 86 facing a window opening formed at a front surface of the case 10 is formed at a second end portion

8*b* in the lengthwise direction of the lever 8. The display 86 is formed as one unit with the lever 8. In the relay 1, when the lever 8 is rotated by the movement of the movable iron core 43, an exposed area on a display surface of the display piece 86 is changed. "ON" and "OFF" are displayed on the display surface of the display piece 86. When the movable contact member 3 is in contact with the fixed contact point 2, only "ON" on the display surface of the display piece 86 is exposed through the window opening. When the movable contact member 3 is separated from the fixed contact point 2, only "OFF" on the display surface of the display piece 86 is exposed through the window opening. In the lever 8, a groove 86*b* is formed on the display surface of the display piece 86 along the width direction of the case 10. Therefore, in the relay 1, the lever 8 can be rotated when a user inserts a leading end portion of a minus driver or the like into the groove 86*b* through the window opening and moves the minus driver.

The bobbin 41 is made of a synthetic resin having an electrical insulation property. The tubular body 41*a* has a square tube shape. The first flange 41*b* and the second flange 41*c* have a rectangular shape.

Figure 9A:
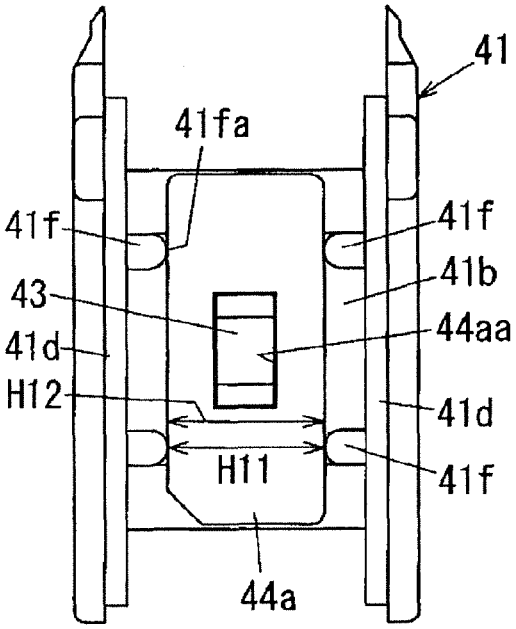
FIG. 9A is a left side view of the electromagnetic device in the relay according to the embodiment.

The first side piece 41*d* has a rectangular plate shape. A length of the first side piece 41*d* in the axial direction of the tubular body 41*a* is greater than a thickness of the first armature 44*a*. A length of the first side piece 41*d* in a direction perpendicular to the facing direction of the pair of first side pieces 41*d* and the axial direction of the tubular body 41*a* is greater than that of the first flange 41*b*. The first ribs 41*f* are formed on the facing surfaces of the pair of first side pieces 41*d* to extend along the axial direction of the tubular body 41*a*. Two first ribs 41*f* are formed at each of the first side pieces 41*d*. The two first ribs 41*f* formed at each of the first side pieces 41*d* are separated from each other in the direction perpendicular to the facing direction of the pair of first side pieces 41*d* and the axial direction of the tubular body 41*a*. As shown in FIG. 9A, a distance H1 between the first ribs 41*f* facing each other in the facing direction of the pair of first side pieces 41*d* is set to be substantially the same as a length H12 of the first armature 44*a* in the facing direction of the pair of first side pieces 41*d*.

Figure 9B:
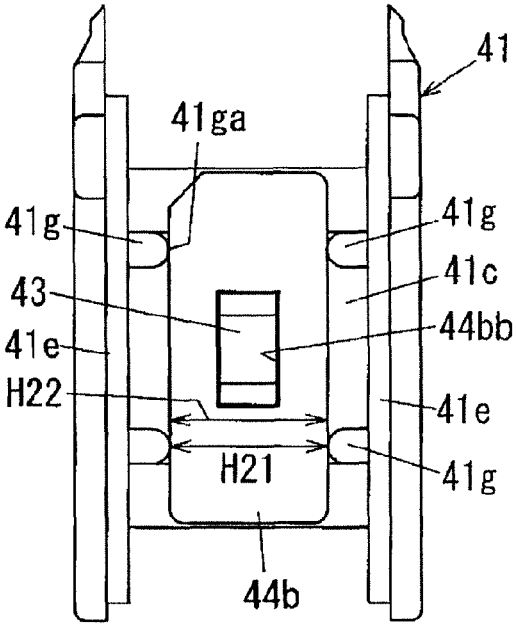
FIG. 9B a right side view of the electromagnetic device in the relay according to the embodiment.
Figure 10:
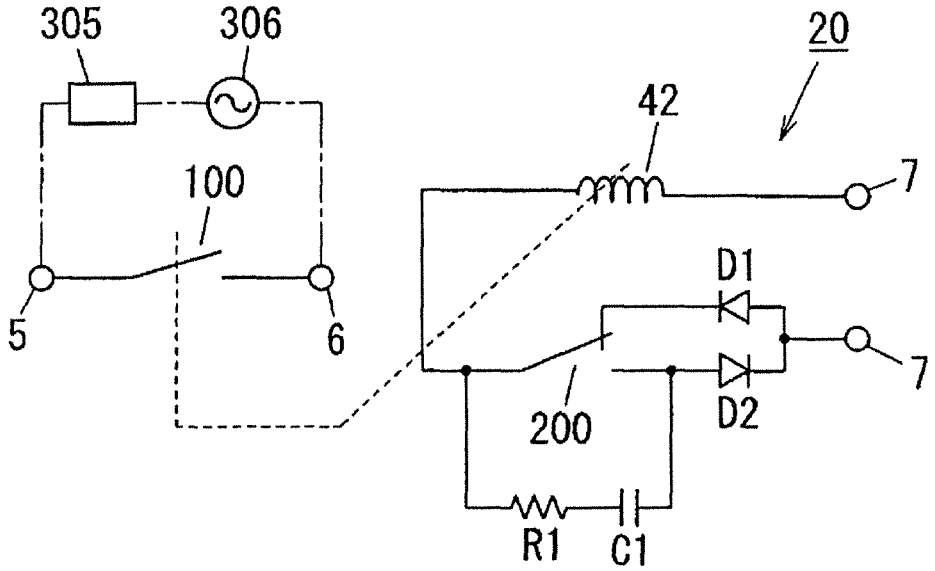
FIG. 10 is a circuit diagram of a conversion circuit in the relay according to the embodiment.

The second side piece 41*e* has a rectangular plate shape. A length of the second side piece 41*e* in the axial direction of the tubular body 41*a* is greater than a thickness of the second armature 44*b*. A length of the second side piece 41*e* in a direction perpendicular to the facing direction of the pair of second side pieces 41*e* and the axial direction of the tubular body 41*a* is greater than that of the second flange 41*c*. The second ribs 41*g* are formed on the facing surfaces of the pair of second side pieces 41*e* to extend along the axial direction of the tubular body 41*a*. Two second ribs 41*g* are formed at each of the second side pieces 41*e*. The two second ribs 41*g* formed at each of the second side pieces 41*e* are separated from each other in the direction perpendicular to the facing direction of the pair of second side pieces 41*e* and the axial direction of the tubular body 41*a*. As shown in FIG. 9B, a distance H21 between the second ribs 41*g* facing each other in the facing direction of the pair of second side pieces 41*e* is set to be substantially the same as a length H22 of the second armature 44*b* in the facing direction of the pair of second side pieces 41*e*.

The movable iron core 43 has a long plate shape, for example. The movable iron core 43 has a uniform thickness. The width of the first end portion 43*a* and that of the second end portion 43*b* in the lengthwise direction are smaller than the width of the intermediate portion 43*c*. Therefore, in the movable iron core 43, the cross sectional areas of the first end portion 43*a* and the second end portion 43*b* in the direction perpendicular to the axial direction of the tubular body 41*a* are smaller than the cross sectional area of the intermediate portion 43*c* in the direction perpendicular to the axial direction of the tubular body 41*a*. The movable iron core 43 has a rectangular cross section in a direction perpendicular to the lengthwise direction.

The first armature 44*a* has a rectangular plate shape. A first opening 44*aa* of the first armature 44*a* is formed at a central portion of the first armature 44*a*. The first opening 44*aa* has a rectangular shape. The first armature 44*a* is a magnetic body.

The second armature 44*b* has a rectangular plate shape. A second opening 44*bb* of the second armature 44*b* is formed at a central portion of the second armature 44*b*. The second opening 44*bb* has a rectangular shape. The second armature 44*b* is a magnetic body.

The electromagnetic device 4 is magnetized by the power supply to the coil 42 such that polarities of the first armature 44*a* and the second armature 44*b* become different from each other. More specifically, the electromagnetic device 4 can change a state in which one of the first armature 44*a* and the second armature 44*b* is magnetized to the N pole and the other is magnetized to the S pole to a state in which the one is magnetized to the S pole and the other is magnetized to the N pole by reversing a direction of a current flowing through the coil 42.

As shown in FIGS. 4 to 6, the electromagnetic device 4 preferably has a non-magnetic plate 48 at a side of the first armature 44*a* which is opposite to the side where the second armature 44*b* is disposed. The plate 48 may be made of, e.g., austenite-based stainless steel. As for the austenite-based stainless steel, it is possible to employ, e.g., SUS304 or the like.

The plate 48 has a rectangular plate shape. A third opening 48*a* greater than the first opening 44*aa* of the first armature 44*a* is formed at a central portion of the plate 48. The plate 48 is preferably fixed to the first armature 44*a*. In the electromagnetic device 4 including the plate 48, the plate 48 is disposed between the first armature 44*a* and the ferromagnetic member 45 when the first armature 44*a* moves toward the ferromagnetic member 45 by the movement of the movable iron core 43. The plate 48 is preferably thinner than the first armature 44*a*.

The ferromagnetic member 45 has a rectangular frame shape surrounding the bobbin 41, the coil 42, the first armature 44*a*, the second armature 44*b* and the like. The ferromagnetic member 45 is disposed such that the axial direction of the ferromagnetic member 45 and the axial direction of the tubular body 41*a* in the bobbin 41 are perpendicular to each other. The axial direction of the ferromagnetic member 45 is in parallel to the facing direction of the pair of first side pieces 41*d* of the bobbin 41.

The ferromagnetic member 45 is formed by combining a pair of yokes 450 each having a substantially U shape. Each of the yokes 450 (hereinafter, referred to as "first yokes 450") has a substantially U shape formed by a central piece 451 and a pair of side pieces 452 protruding from both ends of the central piece 451 in a thickness direction of the central piece 451. The pair of first yokes 450 is arranged in a direction perpendicular to the facing direction of the pair of first side pieces 41*d* of the bobbin 41 and the axial direction of the tubular body 41*a* of the bobbin 41. In the first yokes 450, a distance between the pair of side pieces 452 is set to be longer than a distance between a surface of the first armature 44*a* facing the side piece 452 close thereto and a surface of the second armature 44*b* facing the side piece 452 close thereto.

Each of the first yokes 450 has a first recess 453 forming approximately a half of the first through hole 455 at a leading edge of one of the pair of side pieces 452 close to the first armature 44*a*. Further, each of the first yokes 450 has a second recess 454 forming approximately a half of the second through hole 456 at a leading edge of the other one of the pair of side pieces 452 close to the second armature 44*b*.

In the electromagnetic device 4, an electromagnetic force can be generated when the current is made to flow through the coil 42 and an attractive force can be generated by the electromagnetic force between one of the first armature 44*a* and the second armature 44*b* and the ferromagnetic member 45. In the relay 1, when the first armature 44*a* becomes close to the first yoke 450 in the electromagnetic device 4, the movable contact member 3 is located at the first position in contact with the fixed contact point 2. Further, in the relay 1, when the second armature 44*b* becomes close to the first yoke 450 in the electromagnetic device 4, the movable contact member 3 is located at the second position separated from the fixed contact point 2.

The electromagnetic device 4 includes permanent magnets 46. The permanent magnets 46 have a rectangular plate shape. Each of the permanent magnets 46 is magnetized such that polarities of a first surface 461 and a second surface 462 in a thickness direction thereof become different from each other. Each of the permanent magnets 46 is magnetized such that the first surface becomes the S pole and the second surface becomes the N pole. Each of the permanent magnets 46 is disposed at a surface side of the central piece 451 of the first yoke 450 which faces the coil 42. Each of the permanent magnets 46 is disposed such that the first surface 461 is positioned at the central piece 451 side of the first yoke 450 and the second surface 462 is positioned at the coil 42 side. Accordingly, in the electromagnetic device 4, the ferromagnetic member 45 is magnetized to the same pole as that of the first surfaces 461 of the permanent magnets 46. More specifically, in the electromagnetic device 4, the pair of first yokes 450 forming the ferromagnetic member 45 is magnetized to the S pole.

The electromagnetic device 4 further includes a pair of second yokes 47 smaller than the first yokes 450. The second yoke 47 has a substantially L shape formed by a rectangular plate-shaped main piece 471 and a side piece 472 protruding from one end of the main piece 471 in a thickness direction of the main piece 471. The second yoke 47 is disposed between the permanent magnet 46 and the bobbin 41. More specifically, the second yoke 47 is disposed between the permanent magnet 46 and the coil 42 such that the main piece 471 faces the permanent magnet 46. In the electromagnetic device 4, the second surface 462 of the permanent magnet 46 faces the second yoke 47 side, so that the second yoke 47 is magnetized to the same pole as that of the second surface 462 of the permanent magnet 46. More specifically, in the electromagnetic device 4, the second yoke 47 is magnetized to the N pole. Therefore, in the electromagnetic device 4, the second yoke 47 and the first yoke 450 are magnetized to different polarities.

The second yoke 47 is disposed such that the side piece 472 faces a surface of the second flange 41*c* which faces the second armature 44*b*. The size of the second yoke is set such that the side piece 472 and the second armature 44*b* become close to each other when the first armature 44*a* becomes close to the ferromagnetic member 45 and the other end of the main piece 471 and the first armature 44*a* become close to each other when the second armature 44*b* becomes close to the ferromagnetic member 45. Therefore, in the electromagnetic device 4, if the movable iron core 43 is moved until the first armature 44*a* or the second armature 44*b* becomes close to the ferromagnetic member 450, even when the power supply to the coil 42 is stopped, the position of the movable iron core 43 can be maintained by the magnetic force of the permanent magnet 46. Accordingly, in the relay 1, it is possible to maintain, even after the power supply to the coil 42 is stopped, the state of the contact part 100 (hereinafter, referred to as "first contact part 100") formed by the fixed contact point 2 (hereinafter, referred to as "first fixed contact point 2") and the movable contact member 3 (hereinafter, referred to as "first movable contact member 3").

In the electromagnetic device 4, a magnetic circuit including the first armature 44*a*, the first yoke 450, the permanent magnet 46, the second yoke 47 and the movable iron core 43 is formed when the first armature 44*a* becomes close to the ferromagnetic member 45. Further, in the electromagnetic device 4, a magnetic circuit including the second armature 44*b*, the first yoke 450, the permanent magnet 46, the second yoke 47 and the movable iron core 43 is formed when the second armature 44*b* becomes close to the ferromagnetic member 45.

As described above, the relay 1 is a single winding type bistable relay. The relay 1 includes a conversion circuit 20 (see FIG. 10) for switching a direction of power supply to the coil 42 in order to reciprocally move the movable iron core 43. The conversion circuit 20 includes a first diode D1, a second diode D2, a second contact part 200, a capacitor C1, and a resistor R1.

In the conversion circuit 20, an anode of the first diode D1 and a cathode of the second diode D2 are connected to one of the pair of third terminals 7. The second contact part 200 is configured to selectively connect one of the cathode of the first diode D1 and the anode of the second diode D2 to one end of the coil 42. The other end of the coil 42 is connected to the other third terminal 7 of the pair of third terminals 7. Therefore, in the relay 1, the current flows through the coil 42 in opposite directions between a case where a series circuit of the coil 42 and the first diode D1 is connected between the pair of third terminals 7 and a case where a series circuit of the coil 42 and the second diode D2 is connected between the pair of third terminals 7.

Figure 1:
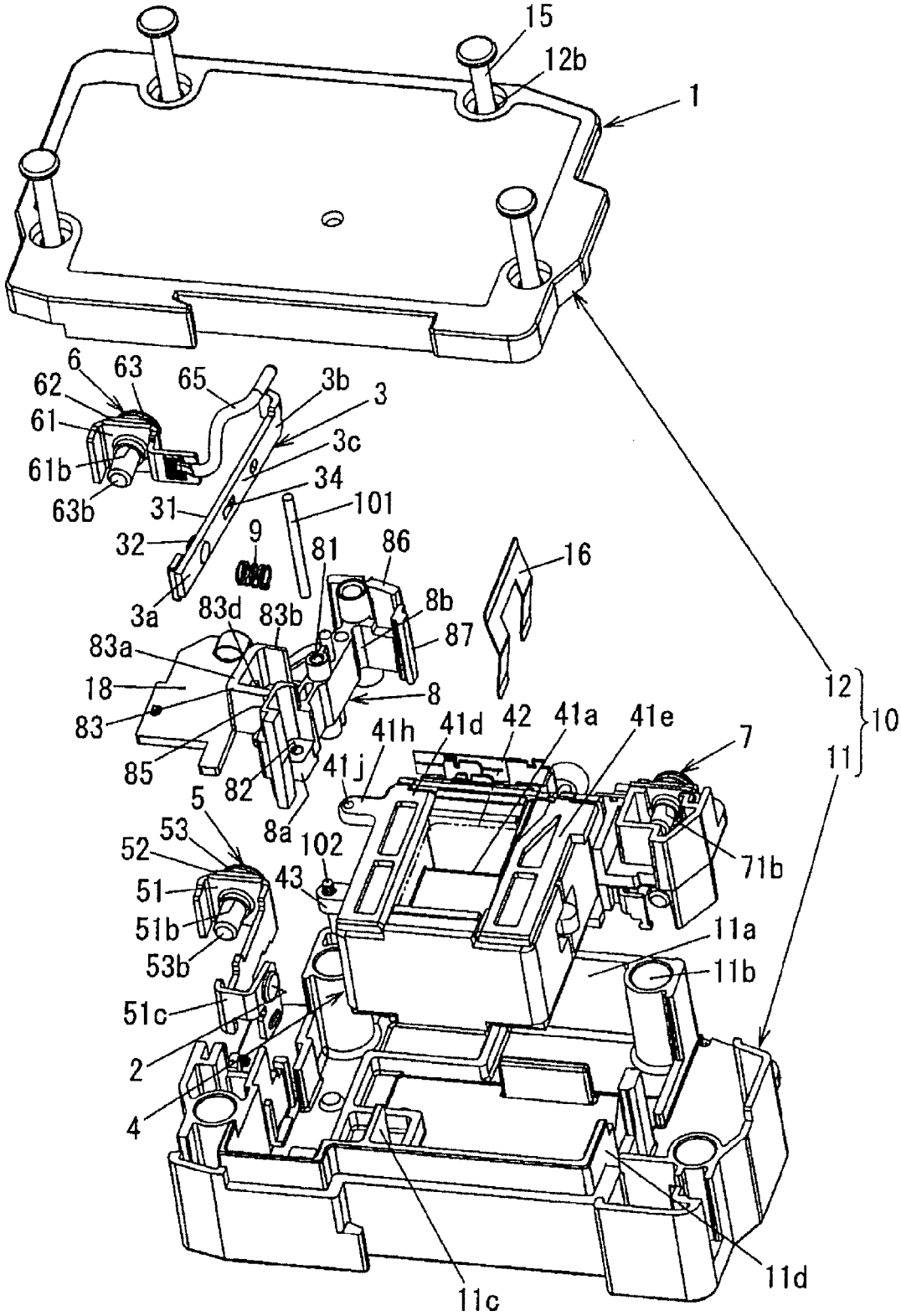
FIG. 1 is a schematic exploded perspective view of a relay according to an embodiment.
Figure 2:
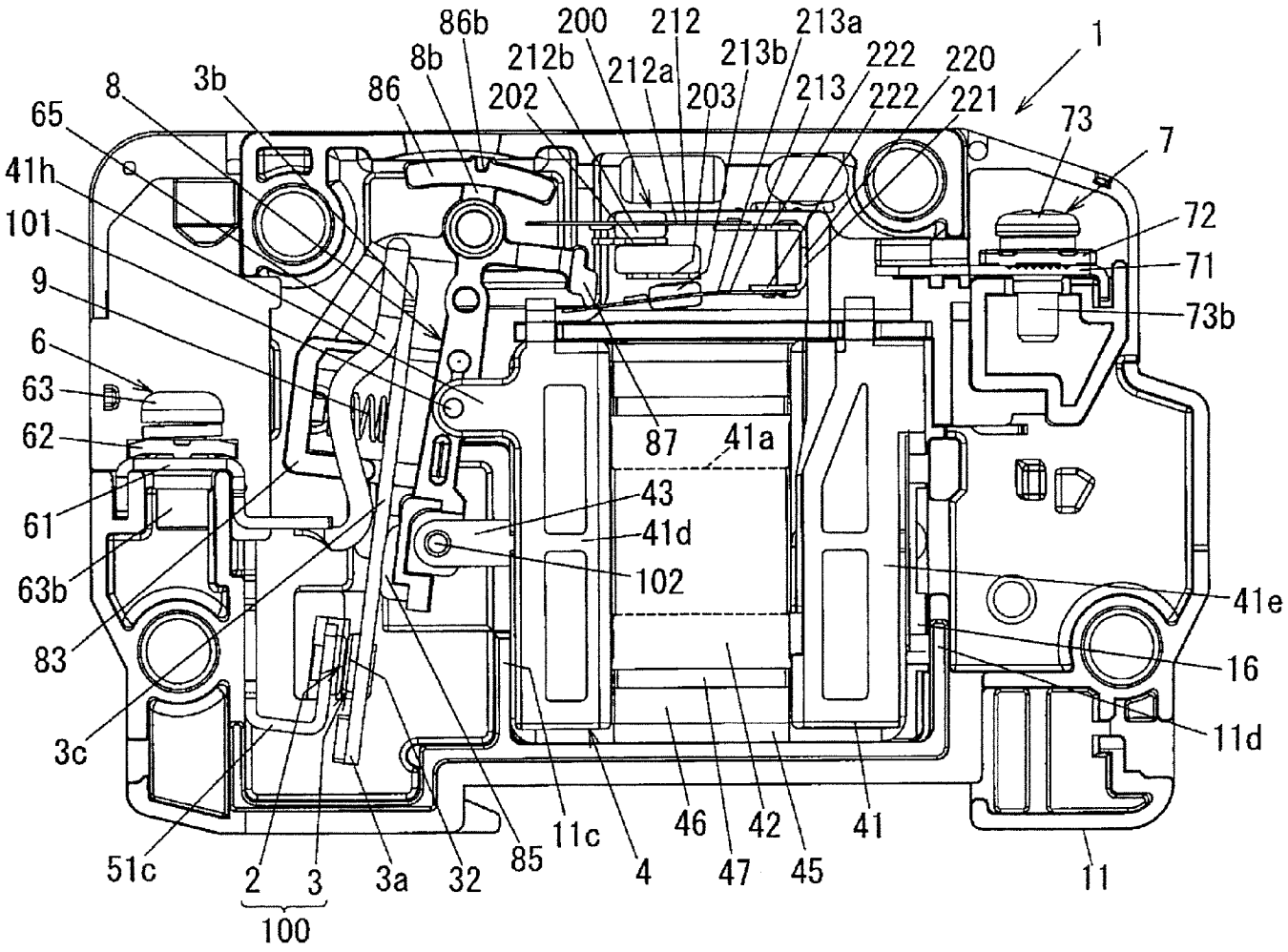
FIG. 2 is a schematic front view of the relay when a movable contact member is in a first position in a state where a cover is removed.
Figure 3:
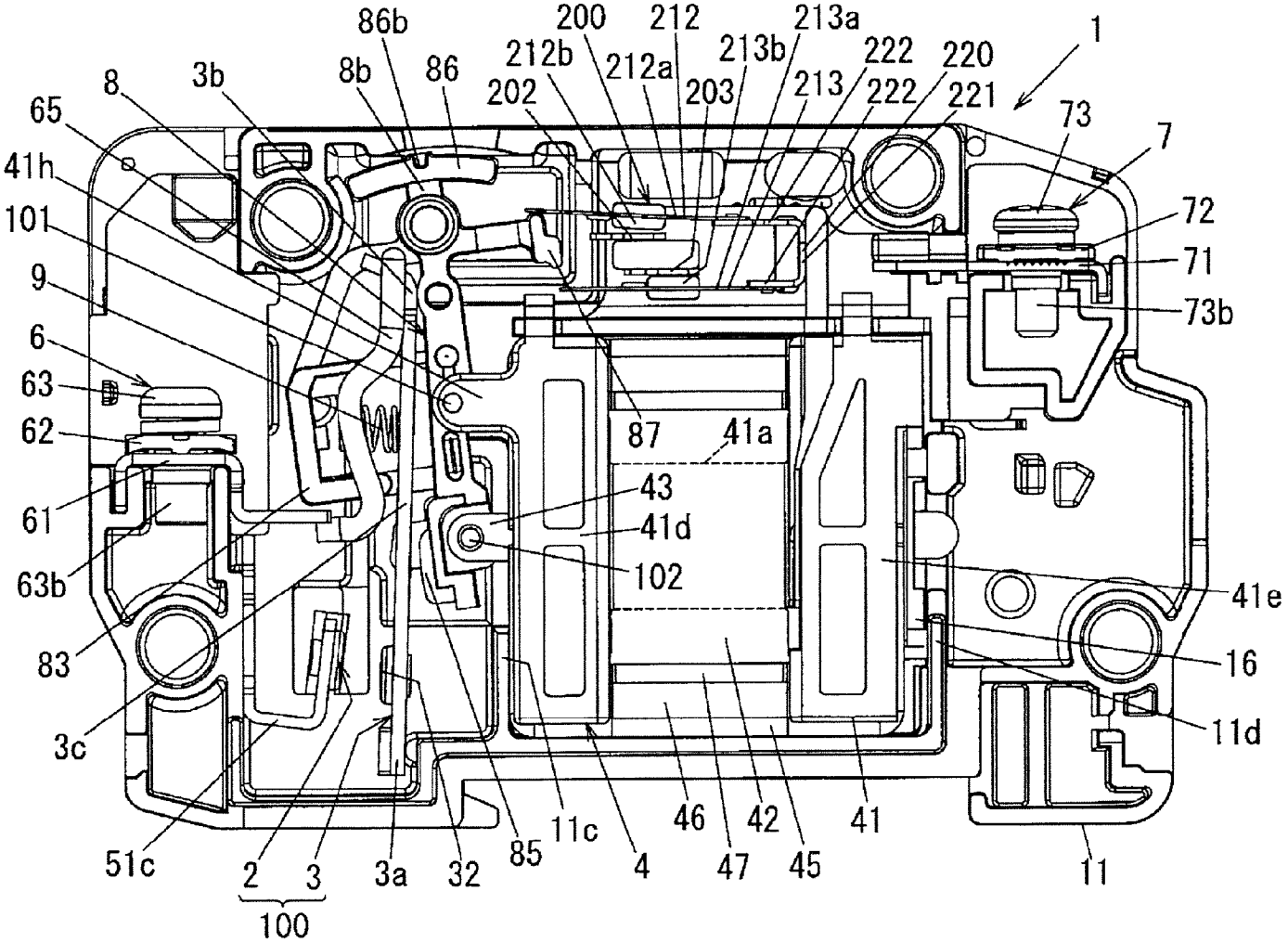
FIG. 3 is a schematic front view of the relay when the movable contact member is in a second position in a state where the cover is removed.

As shown in FIGS. 2 and 3, the second contact part 200 includes a second fixed contact point 202, a third fixed contact point 203, a second movable contact member 212 facing the second fixed contact point 202, and a third movable contact member 213 facing the third fixed contact point 203. The relay 1 includes a supporting plate 220 for supporting the second movable contact member 212 and the third movable contact member 213. The supporting plate 220 is a conductive plate such as a metal plate or the like. In the second contact part 200, the supporting plate 220 is electrically connected to one of the pair of third terminals 7 via the coil 42. Further, in the second contact part 200, the second fixed contact point 202 and the third fixed contact point 203 are electrically connected to the other one of the pair of third terminals 7 via the first diode D1 and the second diode D2, respectively.

The supporting plate 220 has a substantially U shape. The supporting plate 220 has a substantially U shape formed by a central piece 221 and a pair of side pieces 222 having different lengths. In the second contact part 200, the second movable contact member 212 is supported by a longer one of the pair of side pieces 222, and the third movable contact member 213 is supported by a shorter one of the pair of side pieces 222.

The second movable contact member 212 includes a plate spring 212*a* that is a long conductive plate, and a second movable contact point 212*b* that is fixed to the plate spring 212*a* and can be brought into contact with the second fixed contact point 202. The plate spring 212*a* has a spring force acting in a direction that brings the second movable contact member 212 into contact with the second fixed contact point 202. In the second movable contact member 212, the second movable contact point 212*b* and the plate spring 212*a* may be formed as one unit.

The third movable contact member 213 includes a plate spring 213*a* that is a long conductive plate, and a third movable contact point 213*b* that is fixed to the plate spring 213*a* and can be brought into contact with the third fixed contact point 203. The plate spring 213*a* has a spring force acting in a direction that brings the third movable contact member 213 into contact with the third fixed contact point 203. In the third movable contact member 213, the third movable contact point 213*b* and the plate spring 213*a* may be formed as one unit.

In the relay 1, the lever 8 has a manipulation unit 87 that is formed as one unit therewith and selectively presses the second movable contact member 212 and the third second movable contact member 213. The manipulation unit 87 protrudes from a portion of the second end portion 8*b*, in the lengthwise direction, of the lever 8 which is closer to the first bearing hole 81 than the display piece 86. A leading end portion of the manipulation unit 87 is disposed between a leading end portion of the second movable contact member 212 and a leading end portion of the third movable contact member 213. The manipulation unit 87 is separated from one of the second movable contact member 212 and the third movable contact member 213 and presses the other one. The second movable contact member 212 comes in contact with the second fixed contact part 202 when it is not pressed by the manipulation unit 87 and becomes separated from the second fixed contact point 202 when it is pressed by the manipulation unit 87. The third movable contact member 213 comes in contact with the third fixed contact point 203 when it is not pressed by the manipulation unit 87 and becomes separated from the third fixed contact point 203 when it is pressed by the manipulation unit 87.

In the relay 1, when the first armature 44*a* becomes close to the ferromagnetic member 45, the first movable contact member 3 is brought into contact with the first fixed contact point 2; the second movable contact member 212 is brought into contact with the second fixed contact point 202; and the third movable contact member 213 is separated from the third fixed contact point 203. Further, in the relay 1, when the second armature 44*b* becomes close to the ferromagnetic member 45, the first movable contact member 3 is separated from the first fixed contact point 2; the second movable contact member 212 is separated from the second fixed contact point 202; and the third movable contact member 213 is brought into contact with the third fixed contact point 203. Therefore, in the relay 1, the current flows through the coil 42 in opposite directions between a state where the first armature 44*a* is close to the ferromagnetic member 45 and a state where the second armature 44*b* is close to the ferromagnetic member 45.

Hereinafter, the operation of the relay 1 will be described briefly.

As shown in FIG. 3, in the relay 1, if the current flows through the coil 42 so that the magnetization state of the movable iron core 43 is changed in a state where the movable contact member 3 is separated from the fixed contact point 2, the movable iron core 43 is moved so that the first armature 44*a* becomes close to the ferromagnetic member 45. Thus, in the relay 1, the lever 8 is rotated in a clockwise direction in FIG. 3 about the first shaft pin 101 as a rotation axis. In the relay 1, the movable contact member 3 comes in contact with the fixed contact point 2 as shown in FIG. 2 by the clockwise rotation of the lever 8. Further, in the relay 1, the third movable contact member 213 is pressed by the manipulation unit 87 to be separated from the third fixed contact point 203 by the clockwise rotation of the lever 8. Accordingly, in the relay 1, even if the power supply to the coil 42 is stopped, the state in which the first movable contact member 3 is brought into contact with the first fixed contact point 2 is maintained by the magnetic force of the permanent magnet 46.

In the relay 1, if the current flows through the coil in a reversed direction, the movable iron core 43 is moved so that the second armature 44*b* becomes close to the ferromagnetic member 45. Thus, in the relay 1, the lever 8 is rotated in a counterclockwise direction in FIG. 2 about the first shaft pin 101 as the rotation axis. In the relay 1, the movable contact member 3 becomes separated from the fixed contact point 2 as shown in FIG. 3 by the counterclockwise rotation of the lever 8. Further, in the relay 1, the second movable contact member 212 is pressed by the manipulation unit 87 to be separated from the second fixed contact point 202 by the counterclockwise rotation of the lever 8. Accordingly, in the relay 1, the state in which the first movable contact member 3 is separated from the first movable contact point 3 is maintained even if the power supply to the coil 42 is stopped.

The present inventors have studied a relay of a comparative example which has the same configuration as that of the remote control relay disclosed in Japanese Unexamined Patent Application Publication No. 2011-249137. The relay of the comparative example is different from the relay 1 in the shape of the bobbin 41 of the electromagnetic device 4.

Figure 11:
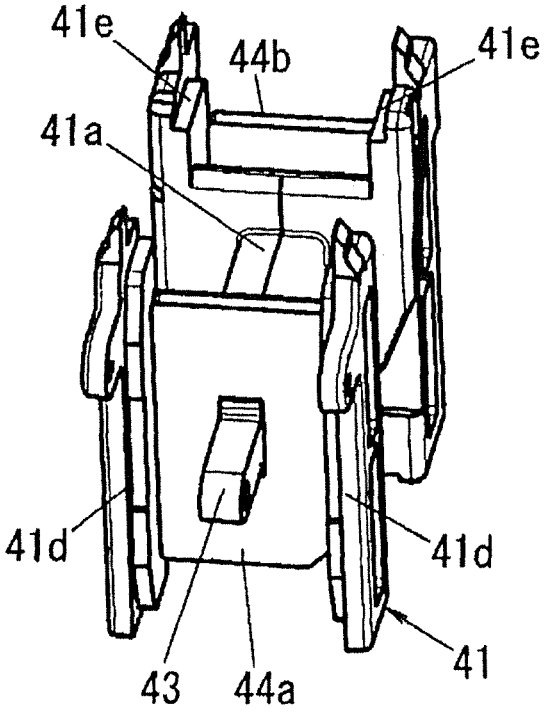
FIG. 11 (RELATED ART)
FIG. 11 is a schematic perspective view of principal parts of an electromagnetic device in a relay of a comparative example.

As shown in FIG. 11, the bobbin 41 in the relay of the comparative example does not include the first ribs 41*f* and the second ribs 41*g* of the bobbin 41 in the relay 1. In the comparative example, in order to prevent wobbling occurring during the movement of the movable iron core 43, a length of the first armature 44*a* in the facing direction of the pair of first side pieces 41*d* of the bobbin 41 is set to be approximately equal to a distance between the pair of first side pieces 41*d*. In the same manner, in the comparative example, a length of the second armature 44*b* in the facing direction of the pair of second side pieces 41*e* of the bobbin 41 is set to be approximately equal to a distance between the pair of second side pieces 41*e*.

However, in the relay of the comparative example, the first armature 44*a* and the second armature 44*b* are not smoothly moved. The present inventors consider that this is caused by a large friction force occurring during the movement of the first armature 44*a* along the pair of first side pieces 41*d* and a large friction force occurring during the movement of the second armature 44*b* along the pair of second side pieces 41*e*.

In the relay of the comparative example, the pair of first side pieces 41*d* of the bobbin 41 is apt to be warped so that the dimension between the pair of first side pieces 41*d* is locally decreased and the first armature 44*a* cannot be inserted between the pair of first side pieces 41*d* in assembling the electromagnetic device. Further, in the relay of the comparative example, the pair of second side pieces 41*e* of the bobbin 41 is apt to be warped so that the dimension between the pair of second side pieces 41*e* is locally decreased and the second armature 44*b* cannot be inserted between the pair of second side pieces 41*e* in assembling the electromagnetic device. The present inventors have found that, in the relay of the comparative example, by winding the coil 42 around the tubular body 41*a* of the bobbin 41, the pair of first side pieces 41*d* and the pair of second side pieces 41*e* are apt to be warped so that the dimension between the pair of first side pieces 41*d* and the dimension between the pair of second side pieces 41*e* are locally increased. Moreover, in the relay of the comparative example, when the movable iron core 43 is moved, the first armature 44*a* and the second armature 44*b* are wobbled and, thus, attractive force characteristics may become non-uniform.

On the other hand, in the relay 1 of the present embodiment, the first armature 44*a* is interposed between the first ribs 41*f* of the pair of first side pieces 41*d* and the second armature 44*b* is interposed between the second ribs 41*g* of the pair of second side pieces 41*e*. Therefore, the relay 1 can reduce the friction force occurring during the movement of the first armature 44*a* along the pair of first side pieces 41*d* and the friction force occurring during the movement of the second armature 44*b* along the second side piece 41*e*. Further, the relay 1 can reduce wobbling of the movable iron core 43 during the movement of the movable iron core 43. Therefore, in the relay 1, the first armature 44*a* and the second armature 44*b* can be moved more smoothly, which makes it possible to improve the operation stability of the electromagnetic device 4. Moreover, the relay 1 can suppress the non-uniformity of the attractive force characteristics. In the relay 1, the first ribs 41*f* facing each other have a function of guiding the first armature 44*a*. Further, in the relay 1, the second ribs 41*g* facing each other have a function of guiding the second armature 44*b*.

In the relay 1, two first ribs 41*f* are formed at each of the first side pieces 41*d*. Therefore, it is possible to further suppress the rotation of the first armature 444*a* in the plane perpendicular to the lengthwise direction of the movable iron core 43 compared to when one first rib 41*f* is formed at each of the first side piece 41*d*. Further, in the relay 1, two second ribs 41*g* are formed at each of the second side pieces 41*e*. Therefore, it is possible to further suppress the rotation of the second armature 44*b* in the plane perpendicular to the lengthwise direction of the movable iron core 43 compared to when one second rib 41*g* is formed at each of the second side piece 41*e*. In the relay 1, since the two first ribs 41*f* are formed at each of the first side piece 41*d* and the two second ribs 41*g* are formed at each of the second side piece 41*e*, it is possible to suppress the warpage of the pair of first side pieces 41*d* and the pair of second side pieces 41*e*. The number of the first ribs 41*f* and the number of the second ribs 41*g* are not limited to two. Since, however, the friction force tends to be increased as the number thereof is increased, two first ribs 41*f* and two second ribs 41*g* are more preferable than three or more first ribs 41*f* and three or more second ribs 41*g*.

Figure 12A:
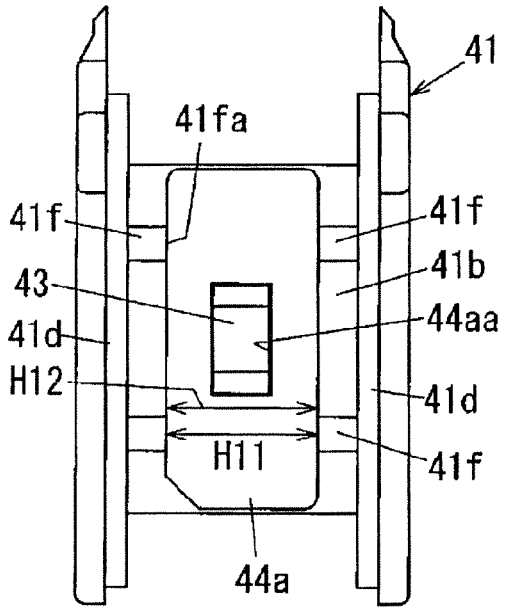
FIG. 12A is a left side view of a first modification of the electromagnetic device in the relay according to the embodiment.
Figure 12B:
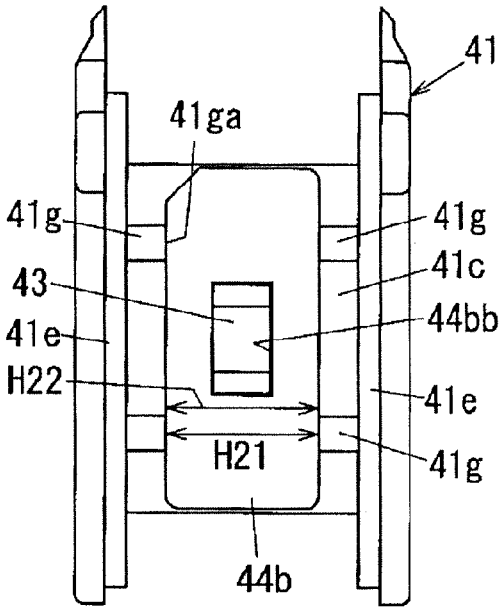
FIG. 12B is a right side view of the first modification of the electromagnetic device in the relay according to the embodiment.

The first rib 41*f* preferably has a first round part 41*fa* at a leading end thereof as shown in FIG. 9A. In the same manner, the second rib 41*g* preferably has a second round part 41*ga* at a leading end thereof as shown in FIG. 9B. In the electromagnetic device 4, when the first rib 41*f* has the first round part 41*fa* at the leading end thereof, the friction force can be reduced compared to when the first rib 41*f* has a rectangular part at the leading end thereof as shown in FIG. 12A and, thus, the operation stability can be improved. In other words, in the electromagnetic device 4, the friction force can be reduced compared to when the facing surfaces of the first rib 41*f* and the first armature 44*a* are approximately in parallel to each other. In the electromagnetic device 4, when the second rib 41*g* has the second round part 41*ga* at the leading end thereof, the friction force can be reduced compared to when the second rib 41*g* has a rectangular part at the leading end thereof as shown in FIG. 12B and, thus, the operation stability can be improved.

Figure 13A:
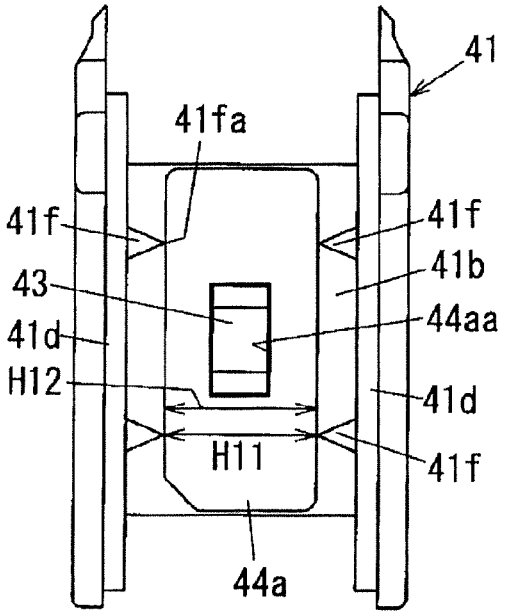
FIG. 13A is a left side view of a second modification of the electromagnetic device in the relay according to the embodiment.
Figure 13B:
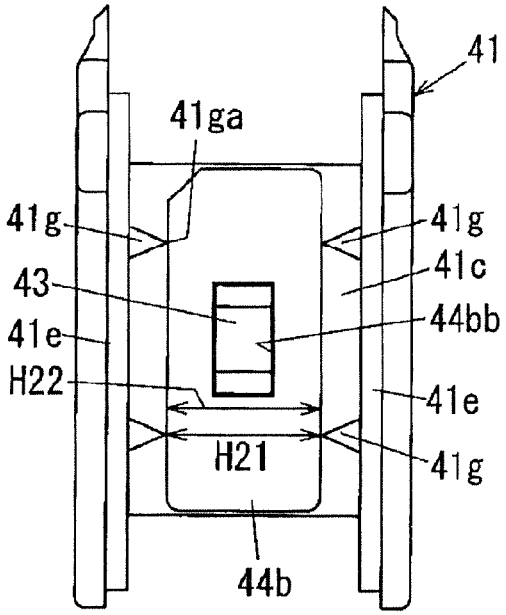
FIG. 13B is a right side view of the second modification of the electromagnetic device in the relay according to the embodiment.

In the electromagnetic device 4, when the first rib 41*f* has the first round part 41*fa* at the leading end thereof, the formability of the bobbin 41 can be improved compared to when the first rib 41*f* has a triangular part at the leading end thereof as shown in FIG. 13A. In the same manner, when the second rib 41*g* has the second round part 41*ga* at the leading end thereof, the formability of the bobbin 41 can be improved compared to when the second rib 41*g* has a triangular part at the leading end thereof as shown in FIG. 13B.

The shape of the first round part 41*fa* and that of the second round part 41*ga* are not limited as long as they do not have at least a right-angled part and the friction force can be reduced. The shapes of the first round part 41*fa* and the second round part 41*ga* seen in the lengthwise direction of the first rib 41*f* and the second rib 41*g* are identical to the cross sectional shapes of the first rib 41*f* and the second rib 41*g* in a direction perpendicular to the axial direction of the tubular body 41. The first round part 41*fa* and the second round part 41*ga* have a circular shape when seen in the lengthwise direction of the first rib 41*f* and the second rib 41*g*. However, the shape thereof is not limited thereto and may be, e.g., a shape with rounded corners or a semi-elliptic spherical shape.

Figure 14A:
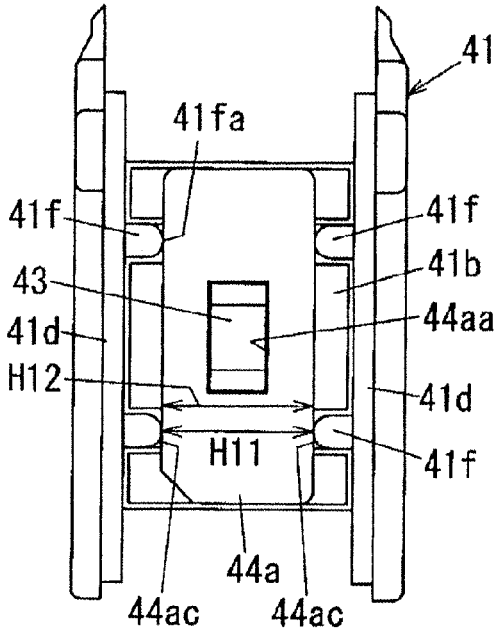
FIG. 14A is a left side view of a third modification of the electromagnetic device in the relay according to the embodiment.
Figure 14B:
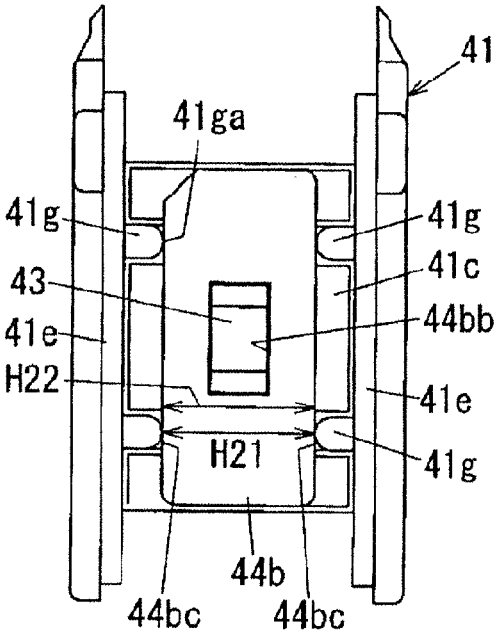
FIG. 14B is a right side view of the third modification of the electromagnetic device in the relay according to the embodiment.

In the electromagnetic device 4, it is preferable to form a first recess 44*ac* (see FIG. 14A), into which the first rib 41*f* is inserted, at a side surface of the first armature 44*a* and form a second recess 44*bc* (see FIG. 14B), into which the second rib 41*g* is inserted, at a side surface of the second armature 44*b*. Accordingly, the relay 1 can further suppress the wobbling of the first armature 44*a* and the second armature 44*b* in a direction perpendicular to the axial direction of the tubular body 41*a* and the pair of first side pieces 41*d* and the pair of second side pieces 41*e*. As a result, the operation stability can be further improved.

Hereinafter, an example of a load control system 300 including the relay 1 will be described with reference to FIGS. 15 and 16.

The load control system 300 includes the relay 1, a first terminal 301 for controlling the relay 1, a second terminal 302 for monitoring a manipulation state of a switch, a transmission control unit 303, and a transformer 304. In the load control system 300, the first terminal 301 and the second terminal 302 are electrically connected to the transmission control unit 303 via a two-wire signal line Ls. In the relay 1, the series circuit of the load 305 and the commercial power supply 306 is connected between the first terminal 5 and the second terminal 6. Further, in the relay 1, one of the pair of third terminals 7 is connected to the transformer 304 and the other third terminal 7 is connected to the first terminal 301. The load control system 300 does not include, as constituent components, the load 305 and the commercial power supply 306. However, the load 305 may be included as a constituent component of the load control system 300.

The first terminal 301 and the second terminal 302 have their own addresses.

The transmission control unit 303 is configured to transmit a transmission signal Vs (see FIG. 16) containing address data between the first terminal 301 and the second terminal 302 via a signal line Ls.

The second terminal 302 is configured to transmit monitoring data describing a manipulation state of the switch 312 to the transmission control unit 303 via the signal line Ls.

In the load control system 300, when the relay 1 is controlled by the first terminal 301, a power is supplied in a pulsed manner from a remote control transformer 304 to the relay 1. The transformer 304 is connected to an AC power supply that is a commercial power supply. The transformer 304 is configured to transform an AC voltage of 100V and supply an AC voltage of 24V to each of the relay 1 and the first terminal 301. The transformer 304 is a remote control transformer for supplying a predetermined voltage (AC voltage of ±24V) to the relay 1.

The first terminal 301 can control relays 1 of up to four circuits and thus has a 2 bit load number for recognizing each relay 1. Hereinafter, a channel of the first terminal 301 and a load number will be referred to as an address. In other words, in the load control system 300, each relay 1 has its own address.

The first terminal 301 controls a relay 1 having the same load number as that in the address data, thereby controlling a load corresponding thereto.

In the load control system 300, the correspondence relation between the address of the second terminal 302 and the address of the relay 1 is managed by the transmission control unit 303. Therefore, in the load control system 300, relays 1 of multiple circuits can be controlled by a single second terminal 302 based on the relation data between addresses of the relays 1 of the multiple circuits and an address of the single second terminal 302 in the transmission control unit 303. In this specification, such control is referred to as batch control. Particularly, the batch control in which a plurality of loads 305 is controlled to the same state is referred to as group control and the batch control in which a plurality of loads 305 is individually controlled to a preset state is referred to as pattern control. The group control or the pattern control is especially effective when the load 305 controlled by the relay 1 is an illumination load. The group control or the pattern control can be used when a plurality of illumination loads is simultaneously turned on/off in an office or the like where the plurality of illumination loads is arranged.

In the load control system 300, the transmission control unit 303, the first terminal 301, the relay 1 and the transformer 304 are preferably disposed inside a distribution board (not shown).

The transmission control unit 303 transmits the transmission signal Vs having a format (signal type) shown in FIG. 16A to the signal line Ls. The transmission signal Vs is a bipolar (±24V) time division multiplex signal and the data is transmitted by pulse width modulation (see FIG. 16B). The transmission signal Vs contains a start pulse signal SY, a mode data MD, an address data AD, a control data CD, a checksum data CS and a signal return period WT. The start pulse signal SY indicates a signal transmission start. The mode data MD indicates a mode of the transmission signal Vs. The address data AD calls the first terminal 301 or the second terminal 302 individually. The control data CD controls the relay 1 or the load 305. The checksum data detects a transmission error. The signal return period WT is a time slot for receiving a return signal from the first terminal 301 or the second terminal 302.

Each of the first terminal 301 and the second terminal 302 takes the control data CD from the transmission signal Vs when its address coincide with the address data AC of the transmission signal Vs received through the signal line Ls. Further, each of the first terminal 301 and the second terminal 302 returns the monitoring data as a current mode signal in the signal return period WT of the transmission signal Vs. The current mode signal is sent out by short-circuiting the signal line Ls through a proper low impedance.

When the data is transmitted to a desired one of the first terminal 301 and the second terminal 302, the transmission control unit 303 sets the mode data MD to the control mode and sends out the transmission signal Vs having the address of the desired one of the first terminal 301 and the second terminal 302 as the address data AD. In the load control system 300, the first terminal 301 or the second terminal 302 which has the address that coincides with the address data AD receives the control data CD and returns the monitoring data in the signal return period WT. The transmission control unit 303 checks that the control data CD has been transmitted to the desired one of the first terminal 301 and the second terminal 301 based on the relation between the transmitted control data CD and the monitoring data received in the signal return period WT.

The first terminal 301 controls the relay 1 based on the received control data CD. The second terminal 302 controls the display unit 313 based on the received control data CD.

The transmission control unit 303 sends out, in a normal state, the transmission signal Vs with the mode data MD set to a dummy mode at a regular time interval (constant normal polling). When there is an information to be transmitted to the transmission control unit 303, the second terminal 302 generates an interrupt signal shown in FIG. 16C in synchronization with a start pulse signal SY of the transmission signal Vs having the dummy mode. At this time, the second terminal 302 sets an interrupt flag to prepare information exchange with the transmission control unit 303.

When the interrupt signal is received, the transmission control unit 303 sets the mode data MD to an interrupt polling mode and sends the transmission signal while increasing high-order half bits (high-order 4 bits when the address data AC has 8 bits) of the address data AD sequentially. The second terminal 302 that has generated the interrupt signal returns, when the high-order 4 bits of the address thereof coincide with the high-order 4 bits of the address data AD of the transmission signal Vs having the interrupt polling mode, low-order 4 bits of the address to the transmission control unit 303 in the signal return period WT. Hence, the transmission control unit 303 can recognize the second terminal 302 that has generated the interrupt signal.

When the address of the second terminal 302 that has generated the interrupt signal is acquired, the transmission control unit 303 sets the mode data MD to the monitoring mode and sends out the transmission signal Vs having the address data AD of the acquired address to the signal line Ls. With respect to the transmission signal Vs, the second terminal 302 returns the monitoring data as a transmission target information in the signal return period WT.

Lastly, the transmission control unit 303 sends out a signal that instructs an interrupt reset to the second terminal 302 that has generated the interrupt signal and releases the interrupt flag of the second terminal 302.

In this manner, the transmission of the monitoring data from the second terminal 302 to the transmission control unit 303 is completed by four signal transmission (the dummy mode, the interrupt polling mode, the monitoring mode and the interrupt reset).

In the transmission control unit 303, when the monitoring data is received through a series of interrupt processes, there is created the control data CD to be transmitted to the first terminal 301 previously made to correspond to the second terminal 302. The transmission control unit 303 performs time division multiplex transmission of the created control data CD together with the address AD of the first terminal 301 by using the transmission signal Vs. The first terminal 301 accessed by the transmission signal Vs controls on/off of the power supply to the load 305 by controlling the relay 1 based on control contents of the control data CD. In other words, in the load control system 300, the first terminal 301 can control the on/off of the power supply to the load 305 through the relay 1 by manipulating the switch 312 of the second terminal 302 corresponding thereto.

Figure 15:
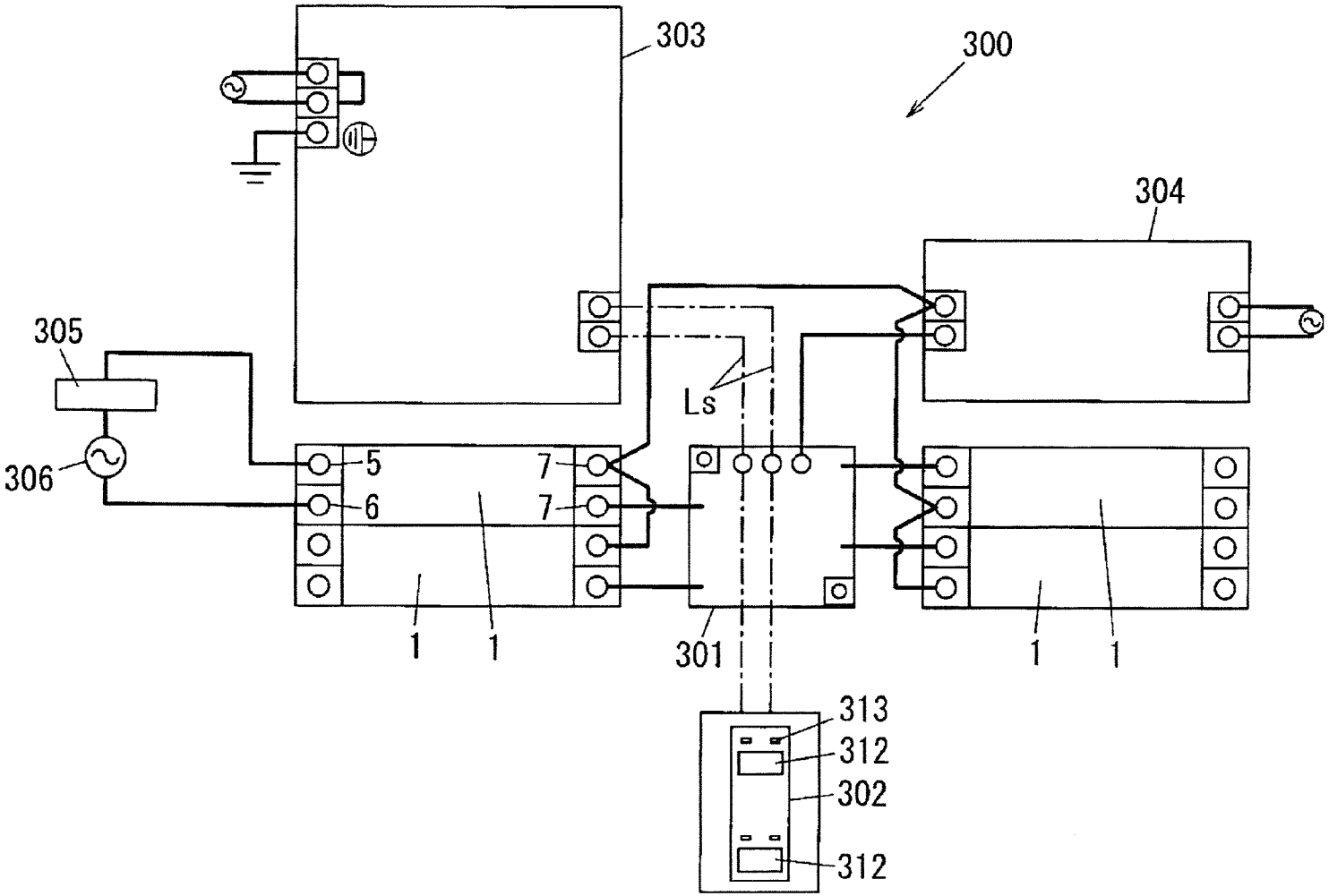
FIG. 15 is a schematic view of a load control system including the relay according to the embodiment.
Figure 16:
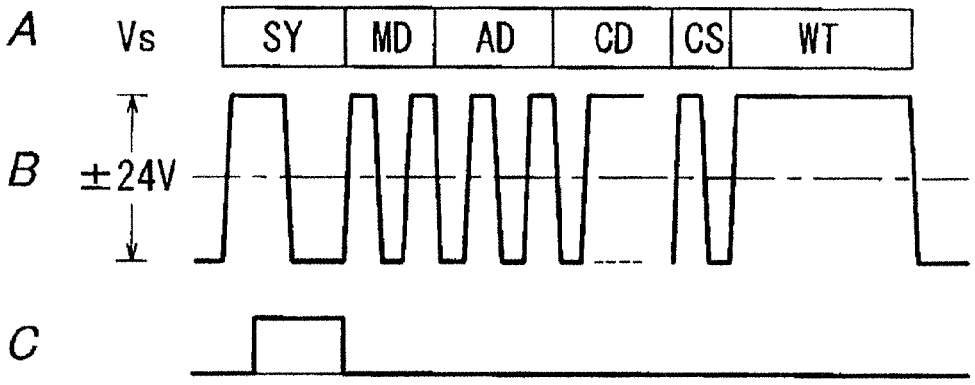
FIG. 16 is a view for explaining a transmission signal of the load control system including the relay according to the embodiment.

In FIG. 15, there are illustrated a single first terminal 301 and a single second terminal 302. However, there may be provided a plurality of first terminals and a plurality of second terminals. The first terminal 301 and the second terminal 302 are connected to the signal line Ls through extended connections.

The diagrams describing the above embodiments are schematic diagrams and the ratio of dimensions or thicknesses of the respective components are not necessarily the same as the actual dimension ratio. Further, the materials, the numerical numbers and the like described in the above embodiments are only desired examples and are not limited thereto. Moreover, the disclosure can be modified without departing from the scope thereof.

What is claimed is:

1. A relay comprising:

a fixed contact point;

a movable contact member; and an electromagnetic device, wherein the movable contact member is moved between a first position in contact with the fixed contact point and a second position separated from the fixed contact point in response to an operation of the electromagnetic device, wherein the electromagnetic device includes a bobbin, a coil, a movable iron core, a first armature, a second armature, and a ferromagnetic member, wherein the bobbin includes:

a tubular body around which the coil is wound, the movable iron core penetrating through the tubular body;

a first flange protruding outward from a first end portion in an axial direction of the tubular body;

a second flange protruding outward from a second end portion in the axial direction of the tubular body;

a pair of first side pieces protruding in a direction opposite to the tubular body from both edges in a width direction of the first flange which is perpendicular to the axial direction of the tubular body; and a pair of second side pieces protruding in a direction opposite to the tubular body from both edges in a width direction of the second flange which is perpendicular to the axial direction of the tubular body, wherein the movable iron core has a first end portion, a second end portion and an intermediate portion therebetween, and cross sectional areas of the first end portion and the second end portion perpendicular to the axial direction of the tubular body are smaller than a cross sectional area of the intermediate portion perpendicular to the axial direction of the tubular body, wherein the first armature has a first hole to which the first end portion of the movable iron core is insertion-fitted, wherein the second armature has a second hole to which the second end portion of the movable iron core is insertion-fitted, wherein the ferromagnetic member has a rectangular frame shape surrounding the bobbin, the coil, the first armature and the second armature, a first insertion hole through which a part of the first end portion of the movable iron core that protrudes beyond the first armature penetrates, and a second insertion hole through which a part of the second end portion of the movable iron core that protrudes beyond the second armature penetrates, wherein the bobbin has at least one first rib formed along the axial direction of the tubular body on each of facing surfaces of the pair of first side pieces and at least one second rib formed along the axial direction of the tubular body on each of facing surfaces of the pair of second side pieces, wherein the first armature is interposed between the first ribs of the pair of first side pieces, and wherein the second armature is interposed between the second ribs of the pair of second side pieces.

2. The relay of claim 1, wherein each of the first ribs has a first round part at a leading end thereof, and wherein each of the second ribs has a second round part at a leading end thereof.

3. The relay of claim 1, wherein two first ribs are formed at each of the pair of first side pieces while being separated from each other in a direction perpendicular to a facing direction of the pair of first side pieces and the axial direction of the tubular body, and wherein two second ribs are formed at each of the pair of second side pieces while being separated from each other in a direction perpendicular to a facing direction of the pair of second side pieces and the axial direction of the tubular body.

4. The relay of claim 1, wherein the first armature has a first recess formed at a side surface thereof to correspond to each of the first ribs, each of the first ribs being inserted into the corresponding first recess, and wherein the second armature has a second recess formed at a side surface thereof to correspond to the each of the second ribs, each of the second rib being inserted into the corresponding second recess.

5. The relay of claim 2, wherein the first armature has a first recess formed at a side surface thereof to correspond to each of the first ribs, each of the first ribs being inserted into the corresponding first recess, and wherein the second armature has a second recess formed at a side surface thereof to correspond to the each of the second ribs, each of the second rib being inserted into the corresponding second recess.

6. The relay of claim 3, wherein the first armature has a first recess formed at a side surface thereof to correspond to each of the first ribs, each of the first ribs being inserted into the corresponding first recess, and wherein the second armature has a second recess formed at a side surface thereof to correspond to the each of the second ribs, each of the second rib being inserted into the corresponding second recess.

* * * * *